US007511464B2

(12) United States Patent
Suzuki

(10) Patent No.: US 7,511,464 B2
(45) Date of Patent: Mar. 31, 2009

(54) VOLTAGE REGULATOR

(75) Inventor: Teruo Suzuki, Chiba (JP)

(73) Assignee: Seiko Instruments Inc., Chiba (JP)

( * ) Notice: Subject to any disclaimer, the term of this patent is extended or adjusted under 35 U.S.C. 154(b) by 92 days.

(21) Appl. No.: 11/879,284

(22) Filed: Jul. 17, 2007

(65) Prior Publication Data

US 2008/0048629 A1 Feb. 28, 2008

(30) Foreign Application Priority Data

Jul. 18, 2006 (JP) ..... 2006-195462

(51) Int. Cl.
*G05F 1/565* (2006.01)
*G05F 1/573* (2006.01)

(52) U.S. Cl. ..... 323/275; 323/277; 323/908

(58) Field of Classification Search ..... 323/273, 323/274, 275, 276, 277, 279, 304, 311, 316, 323/349, 350, 908
See application file for complete search history.

(56) References Cited

U.S. PATENT DOCUMENTS

| | | | | |
|---|---|---|---|---|
| 5,272,399 | A * | 12/1993 | Tihanyi et al. | 327/379 |
| 6,573,693 | B2 * | 6/2003 | Okamoto | 323/273 |
| 6,897,638 | B2 * | 5/2005 | Miyanaga et al. | 323/274 |
| 7,215,180 | B2 * | 5/2007 | Nagata et al. | 327/538 |
| 7,411,376 | B2 * | 8/2008 | Zhang | 323/277 |

FOREIGN PATENT DOCUMENTS

JP 2003-271251 A 9/2003

* cited by examiner

*Primary Examiner*—Gary L Laxton
(74) *Attorney, Agent, or Firm*—Brinks Hofer Gilson & Lione

(57) ABSTRACT

Provided is a voltage regulator in which a rush current of an output circuit can be limited and a rise time of an output voltage is short. The voltage regulator includes a first output current limiting circuit and a second output current limiting circuit which are used to control the output circuit, and a detecting circuit for detecting a rise speed of an input voltage. The operation of the first output current limiting circuit whose detection current value is low is controlled by the detecting circuit.

8 Claims, 2 Drawing Sheets

VOLTAGE REGULATOR

This application claims priority under 35 U.S.C. § 119 to Japanese Patent Application No. JP2006-195462 filed Jul. 18, 2006, the entire content of which is hereby incorporated by reference.

BACKGROUND OF THE INVENTION

1. Field of the Invention

The present invention relates to a voltage regulator for generating a constant voltage based on an input voltage.

2. Description of the Related Arts

A mobile electronic device such as a mobile telephone is generally operated by power supplied from a rechargeable battery. An output voltage of the rechargeable battery changes corresponding to a charging state. In order to stably operate the mobile electric device, it is necessary to apply a constant voltage to the mobile electric device. Therefore, the mobile electric device includes a voltage regulator for generating a constant voltage without depending on the output voltage of the rechargeable battery. For circuit protection, the voltage regulator includes a rush current limiting circuit for limiting a rush current of an output stage transistor.

Hereinafter, a conventional voltage regulator including a rush current limiting circuit will be described. FIG. 4 is a schematic circuit diagram showing the conventional voltage regulator.

The conventional voltage regulator includes an amplifying circuit 25 for comparing a reference voltage with a dividing voltage obtained by division of an output voltage, an output stage transistor T23 through which a drain current corresponding to an output voltage of the amplifying circuit 25 flows, a testing transistor T24, a current limiting circuit 20 for controlling a gate voltage to the transistor T23 and the transistor T24 based on the drain current of the transistor T24, a switch circuit 30 for switching between input paths of the drain current flowing from the transistor T24 to the current limiting circuit 20, an on/off circuit 26 for controlling an on/off operation of the voltage regulator, and a counter circuit 27 for measuring an elapsed time from the time when the voltage regulator is turned on. The on/off circuit 26, the counter circuit 27, and the current limiting circuit 20 are collectively referred to as a rush current limiting circuit.

The current limiting circuit 20 includes a first output current limiting circuit 21 and a second output current limiting circuit 22. The first output current limiting circuit 21 detects a first current limit value to limit the drain current of the transistor T23. The second output current limiting circuit 22 detects a second current limit value higher than the first current limit value to limit the drain current of the transistor T23. The counter circuit 27 controls the switch circuit 30 based on the elapsed time. The switch circuit 30 connects the transistor T24 with the first output current limiting circuit 21 until a predetermined elapsed time has elapsed. After the predetermined elapsed time has elapsed, the switch circuit 30 connects the transistor T24 with the second output current limiting circuit 22.

The operation of the conventional voltage regulator as described above will be described.

When the voltage regulator is turned on, the on/off circuit 26 causes the amplifying circuit 25 to start activation and causes the counter circuit 27 to start counting. In order to rapidly charge an external capacitor (not shown) connected with an output voltage terminal, an excessive drain current (rush current) flows through the transistor T23. A drain current proportional to the rush current, of the transistor T24 flows into the current limiting circuit 20. The switch circuit 30 selects the first output current limiting circuit 21 based on an output of the counter circuit 27. When the drain current becomes equal to or larger than the first current limit value, the first output current limiting circuit 21 controls the gate voltage to the transistor T23 and the transistor T24 to reduce the drain currents thereof. After a predetermined time has elapsed from the time when the voltage regulator is turned on, the switch circuit 30 selects the second output current limiting circuit 22 based on an output of the counter circuit 27 (see, for example, JP 2003-271251 A).

When an input voltage slowly increases, it is unnecessary to limit the drain current of the output stage transistor by the voltage regulator. However, until the predetermined elapsed time has elapsed from the time when the conventional voltage regulator is turned on, the first output current limiting circuit 21 whose current limit value is low limits the drain current of the output stage transistor T23. Therefore, because of unnecessary limitation given to the drain current, a current for charging the external capacitor connected with the output voltage terminal reduces, with the result that a rise time of the output voltage of the voltage regulator becomes longer.

SUMMARY OF THE INVENTION

A voltage regulator according to the present invention includes: a detecting circuit for detecting a rise speed of an input voltage; an output circuit for generating an output current; a first output current detecting circuit connected with an output of the amplifying circuit, for detecting an output current at the output terminal; a first output current limiting circuit connected with the detecting circuit and the first output current detecting circuit, for controlling the output circuit; a second output current detecting circuit connected with the output of the amplifying circuit, for detecting the output current at the output terminal; and a second output current limiting circuit connected with the second output current detecting circuit, for controlling the output circuit.

According to the voltage regulator of the present invention, a first output current limit value of the first output current limiting circuit is lower than a second output current limit value of the second output current limiting circuit and the detecting circuit enables operation of the first output current limiting circuit only when a rise speed of the input voltage is fast.

Thus, according to the voltage regulator of the present invention, a rush current of the output circuit can be limited and a rise time of the output voltage can be shortened.

DESCRIPTION OF THE PREFERRED EMBODIMENTS

Embodiment 1

Figure 1:
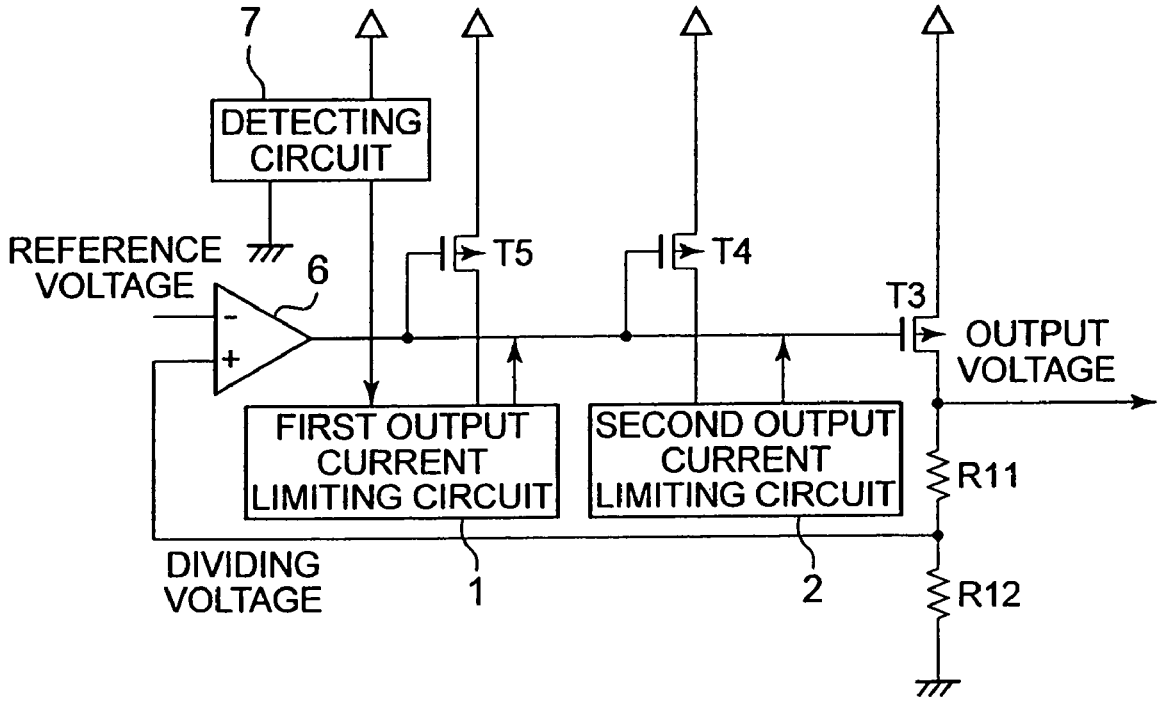
FIG. 1 is a block diagram showing a voltage regulator according to Embodiment 1 of the present invention.

FIG. 1 is a block diagram showing a voltage regulator according to Embodiment 1.

The voltage regulator according to Embodiment 1 includes an amplifying circuit 6 for comparing a dividing voltage obtained by dividing an output voltage by resistors R11 and R12 with a reference voltage, a PMOS transistor T3 (output circuit) whose gate is connected with an output terminal of the amplifying circuit 6, a PMOS transistor T5 (first output current detecting circuit) whose gate is connected with the output terminal of the amplifying circuit 6, a first output current limiting circuit 1 for controlling a gate voltage of the PMOS transistor T3 based on a drain current of the PMOS transistor T5, a PMOS transistor T4 (second output current detecting circuit) whose gate is connected with the output terminal of the amplifying circuit 6, a second output current limiting circuit 2 for controlling a gate voltage of the PMOS transistor T3 based on a drain current of the PMOS transistor T4, and a detecting circuit 7 for detecting a rise speed of an input voltage of the voltage regulator to control the operation of the first output current limiting circuit 1.

The voltage regulator according to Embodiment 1 operates as described below.

The amplifying circuit 6 compares the dividing voltage obtained by dividing the output voltage by the resistors R11 and R12 with the reference voltage and generates a voltage corresponding to a result obtained by the comparison. The PMOS transistor T3 is used to output a drain current corresponding to a voltage (gate voltage) outputted from the amplifying circuit 6 as an output current to an output terminal of the voltage regulator. The gate of the PMOS transistor T4 serving as the second output current detecting circuit is commonly connected with the gate of the PMOS transistor T3, so a current proportional to the output current flows into a drain of the PMOS transistor T4. The second output current limiting circuit 2 controls the gate voltage of the PMOS transistor T3 based on the drain current of the PMOS transistor T4. The gate of the PMOS transistor T5 serving as the first output current detecting circuit is commonly connected with the gate of the PMOS transistor T3, so a current proportional to the output current flows into a drain of the PMOS transistor T5. The first output current limiting circuit 1 controls the gate voltage of the PMOS transistor T3 based on the drain current of the PMOS transistor T5.

Note that a first output current limit value of the first output current limiting circuit is set to a value lower than a second output current limit value of the second output current limiting circuit. The operation of the first output current limiting circuit is controlled based on an output of the detecting circuit 7 which detects the rise speed of the input voltage of the voltage regulator. The detecting circuit 7 enables the first output current limiting circuit when the rise speed of the input voltage is fast.

First, the operation in a case where the rise speed of the input voltage of the voltage regulator at the time of activation thereof is fast will be described. The rise speed of the input voltage is fast and the reference voltage is rapidly risen, so the reference voltage inputted to an inverting input terminal of the amplifying circuit 6 becomes significantly higher than the dividing voltage inputted to a noninverting input terminal thereof. Therefore, the output voltage of the amplifying circuit 6 reduces to reduce the gate voltage, so the drain current of the PMOS transistor T3 becomes excessively large (rush current). Here, the detecting circuit 7 enables operation of the first output current limiting circuit 1. When the drain current of the PMOS transistor T5 becomes equal to or larger than the first output current limit value, the first output current limiting circuit 1 controls the gate voltage of the PMOS transistor T3 to reduce the drain current (rush current). The first output current limit value of the first output current limiting circuit 1 is set to a value lower than the second output current limit value of the second output current limiting circuit 2, so a speed for limiting the rush current can be further increased.

After a predetermined elapsed time has elapsed from the time when the voltage regulator is activated, the operation of the first output current limiting circuit 1 is stopped by the detecting circuit 7 and only the second output current limiting circuit 2 operates.

Next, the operation in a case where the rise speed of the input voltage of the voltage regulator at the time of activation thereof is slow will be described. The rise speed of the input voltage is slow and the reference voltage is slowly risen, so the reference voltage inputted to the inverting input terminal of the amplifying circuit 6 does not become significantly higher than the dividing voltage inputted to the noninverting input terminal thereof. Therefore, the output voltage of the amplifying circuit 6 increases to increase the gate voltage, so the drain current of the PMOS transistor T3 does not become excessively large. Because the rise speed of the input voltage is slow, the operation of the first output current limiting circuit 1 is stopped by the detecting circuit 7 and only the second output current limiting circuit 2 operates. The second output current limit value of the second output current limiting circuit 2 is set to a value higher than the first output current limit value of the first output current limiting circuit 1, so the drain current of the PMOS transistor T3 easily flows, thereby shortening the rise time of the output voltage of the voltage regulator.

Figure 2:
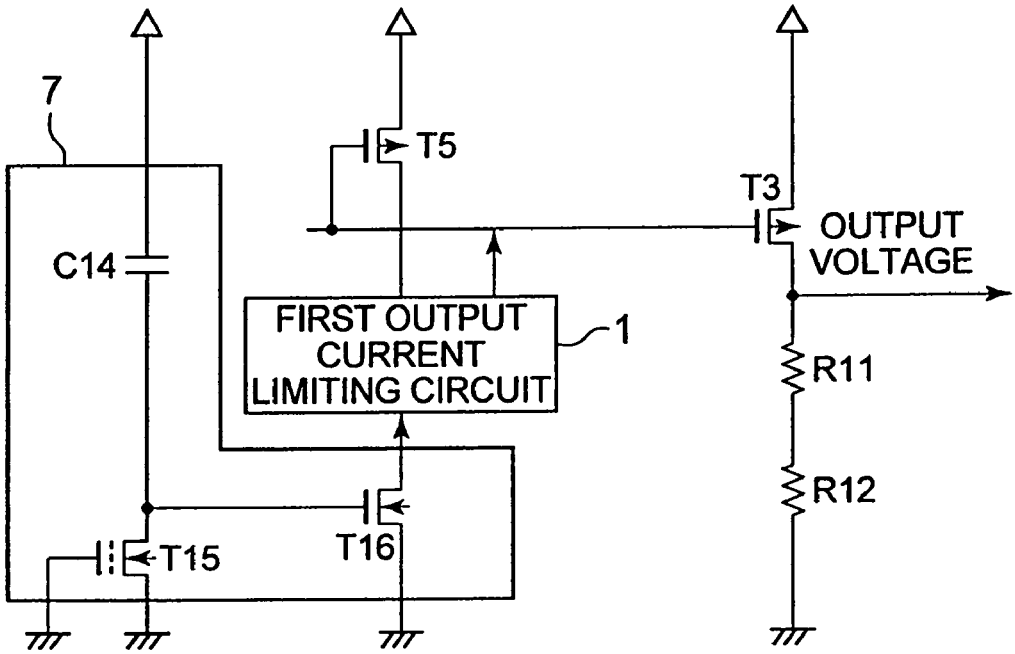
FIG. 2 is a circuit diagram showing a detecting circuit.

FIG. 2 is a circuit diagram showing an example of the detecting circuit 7.

The detecting circuit 7 includes a capacitor C14 in which the input voltage is inputted to one end thereof, a depletion NMOS transistor T15 whose drain electrode is connected with the other end of the capacitor C14 and whose gate electrode and source electrode are grounded, and an enhancement NMOS transistor T16 whose drain electrode is connected with the first output current limiting circuit 1, whose gate electrode is connected with the other end of the capacitor C14, and whose source electrode is grounded.

The enhancement NMOS transistor T16 controls the start and stop of the operation of the first output current limiting circuit 1. A gate voltage of the enhancement NMOS transistor T16 is controlled by the capacitor C14 and the depletion NMOS transistor T15.

When the input voltage of the voltage regulator is inputted, charges are stored in the capacitor C14 to increase the gate voltage of the enhancement NMOS transistor T16. When the input voltage is rapidly risen, a charging speed of the capacitor C14 is faster than a discharging speed of the depletion NMOS transistor T15. Therefore, when the gate voltage of the enhancement NMOS transistor T16 increases and exceeds a threshold value, the enhancement NMOS transistor T16 is turned on, so the operation of the first output current limiting circuit 1 is enabled.

After that, the capacitor C14 storing the charges is gradually discharged through the depletion NMOS transistor T15.

When the gate voltage of the enhancement NMOS transistor T16 gradually reduces and becomes smaller than the threshold value, the enhancement NMOS transistor T16 is turned off, so the operation of the first output current limiting circuit 1 is stopped.

A detection level for the rise speed of the input voltage of the voltage regulator and an operating time of the first output current limiting circuit 1 are set based on a capacitance value of the capacitor C14, the driving power of the depletion NMOS transistor T15, and the threshold value of the enhancement NMOS transistor T16.

Embodiment 2

Figure 3:
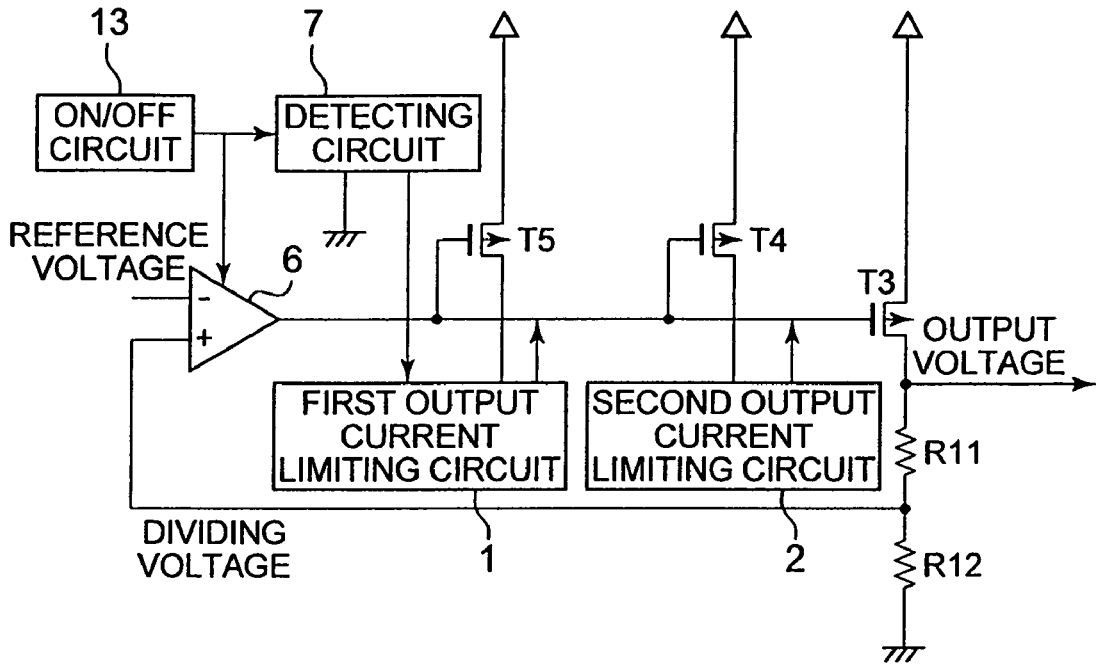
FIG. 3 is a block diagram showing a voltage regulator according to Embodiment 2 of the present invention.
Figure 4:
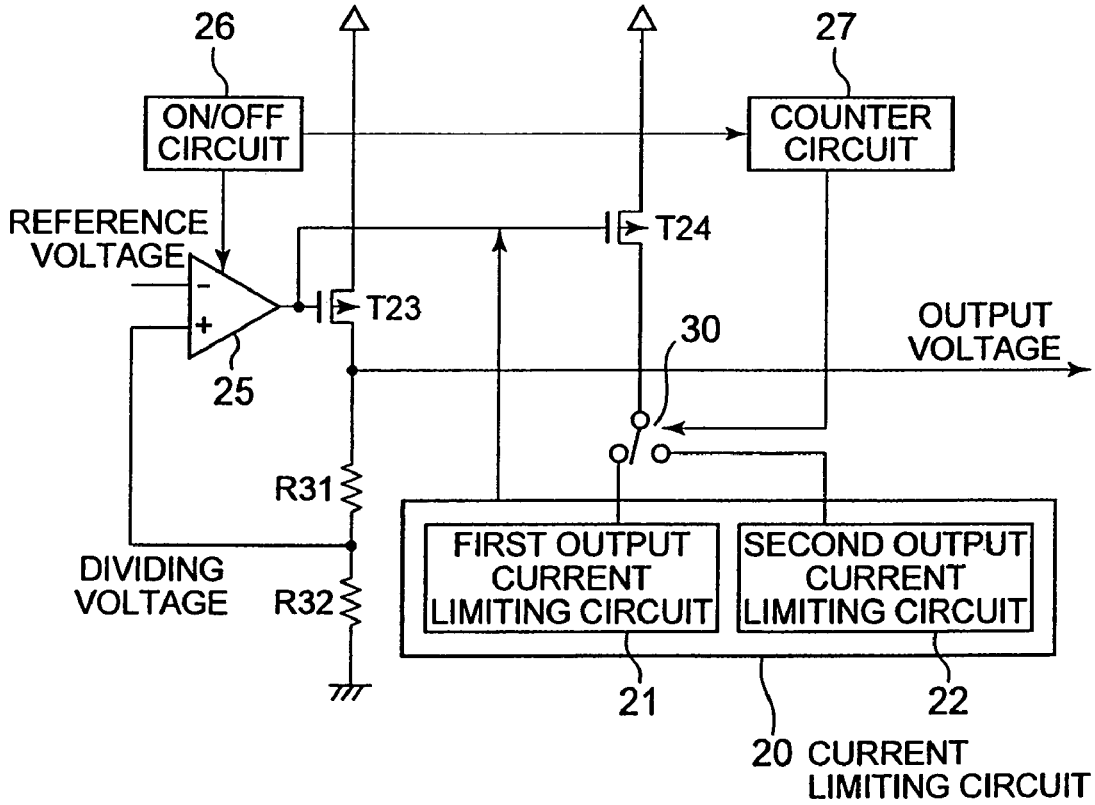
FIG. 4 PRIOR ART
FIG. 4 is a block diagram showing a conventional voltage regulator.

FIG. 3 is a block diagram showing a voltage regulator according to Embodiment 2. The voltage regulator according to Embodiment 2 has a structure in which an on/off circuit 13 is further provided in the voltage regulator according to Embodiment 1.

The on/off circuit 13 performs the on/off control of the voltage regulator. The on/off circuit 13 has an output terminal connected with the amplifying circuit 6 and the detecting circuit 7. The on/off circuit 13 outputs a control signal to each of the amplifying circuit 6 and the detecting circuit 7 in response to a signal from an outside to perform the on/off control of the voltage regulator.

The voltage regulator according to Embodiment 2 operates as follows.

When the voltage regulator is turned on, the on/off circuit 13 outputs the control signal to each of the amplifying circuit 6 and the detecting circuit 7 to turn on the voltage regulator. Then, the detecting circuit 7 detects the rise speed of the input voltage. When the rapid rise of the input voltage is detected, the first output current limiting circuit 1 is operated.

The subsequent operation is identical to that of the voltage regulator according to Embodiment 1.

What is claimed is:

1. A voltage regulator, comprising:

a dividing circuit connected with an output terminal, for dividing an output voltage;

an amplifying circuit to which a dividing voltage from the dividing circuit and a reference voltage are inputted, for generating a signal for controlling an output circuit;

a detecting circuit connected with a voltage input terminal, for detecting a rise speed of an input voltage;

a first output current detecting circuit connected with an output of the amplifying circuit, for detecting an output current at the output terminal;

a first output current limiting circuit connected with the detecting circuit and the first output current detecting circuit, for controlling the output circuit;

a second output current detecting circuit connected with the output of the amplifying circuit, for detecting the output current at the output terminal; and a second output current limiting circuit connected with the second output current detecting circuit, for controlling the output circuit, wherein:

the first output current limiting circuit has a first output current limit value;

the second output current limiting circuit has a second output current limit value lower than the first output current limit value; and the detecting circuit enables operation of the first output current limiting circuit when the rise speed of the input voltage is rapid.

2. A voltage regulator, comprising:

a dividing circuit connected with an output terminal, for dividing an output voltage;

an amplifying circuit to which a dividing voltage from the dividing circuit and a reference voltage are inputted, for generating a signal for controlling an output circuit;

an on/off circuit for controlling an operation of the amplifying circuit;

a detecting circuit connected with the on/off circuit, for detecting a rise speed of an input voltage at a voltage input terminal when the on/off circuit generates a signal for activating the amplifying circuit;

a first output current detecting circuit connected with an output of the amplifying circuit, for detecting an output current at the output terminal;

a first output current limiting circuit connected with the detecting circuit and the first output current detecting circuit, for controlling the output circuit;

a second output current detecting circuit connected with the output of the amplifying circuit, for detecting the output current at the output terminal; and a second output current limiting circuit connected with the second output current detecting circuit, for controlling the output circuit, wherein:

the first output current limiting circuit has a first output current limit value;

the second output current limiting circuit has a second output current limit value lower than the first output current limit value; and the detecting circuit enables operation of the first output current limiting circuit when the rise speed of the input voltage is rapid.

3. A voltage regulator according to claim 1, wherein the detecting circuit comprises:

a capacitor whose first terminal is connected with the voltage input terminal;

a constant current source connected with a second terminal of the capacitor; and a switch circuit switch-controlled based on a voltage at the second terminal of the capacitor.

4. A voltage regulator according to claim 3, wherein the constant current source comprises a depletion NMOS transistor whose gate and source are grounded.

5. A voltage regulator according to claim 3, wherein the switch circuit comprises an NMOS transistor whose gate is connected with a connection point between the capacitor and the constant current source and whose drain is connected with the first output current limiting circuit.

6. A voltage regulator according to claim 2, wherein the detecting circuit comprises:

a capacitor whose first terminal is connected with the voltage input terminal;

a constant current source connected with a second terminal of the capacitor; and a switch circuit switch-controlled based on a voltage at the second terminal of the capacitor.

7. A voltage regulator according to claim 6, wherein the constant current source comprises a depletion NMOS transistor whose gate and source are grounded.

8. A voltage regulator according to claim 6, wherein the switch circuit comprises an NMOS transistor whose gate is connected with a connection point between the capacitor and the constant current source and whose drain is connected with the first output current limiting circuit.

* * * * *